US009114614B2

(12) United States Patent
Nagai et al.

(10) Patent No.: US 9,114,614 B2
(45) Date of Patent: Aug. 25, 2015

(54) LIQUID EJECTION HEAD

(71) Applicant: CANON KABUSHIKI KAISHA, Tokyo (JP)

(72) Inventors: Masataka Nagai, Yokohama (JP); Yoshinori Tagawa, Yokohama (JP); Jun Yamamuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/287,732

(22) Filed: May 27, 2014

(65) Prior Publication Data

US 2014/0362140 A1 Dec. 11, 2014

(30) Foreign Application Priority Data

Jun. 5, 2013 (JP) ..... 2013-118725

(51) Int. Cl.

| | |
|---|---|
| ***B41J 29/38*** | (2006.01) |
| ***B41J 2/135*** | (2006.01) |
| ***B41J 2/14*** | (2006.01) |
| ***B41J 2/16*** | (2006.01) |

(52) U.S. Cl.

CPC ..... *B41J 2/1433* (2013.01); *B41J 2/14016* (2013.01); *B41J 2/1603* (2013.01); *B41J 2/1631* (2013.01); *B41J 2/1639* (2013.01); *B41J 2/1645* (2013.01); *B41J 2202/11* (2013.01)

(58) Field of Classification Search

USPC ..... 347/47, 9, 44

See application file for complete search history.

(56) References Cited

U.S. PATENT DOCUMENTS

| | | | | |
|---|---|---|---|---|
| 7,628,469 | B2 | 12/2009 | Inoue | |
| 2003/0048328 | A1* | 3/2003 | Inamoto et al. | 347/44 |
| 2013/0286091 | A1* | 10/2013 | Takahashi et al. | 347/33 |

FOREIGN PATENT DOCUMENTS

| | | | |
|---|---|---|---|
| JP | 2000-158657 | A | 6/2000 |
| JP | 2007-283501 | A | 11/2007 |

* cited by examiner

*Primary Examiner* — Jason Uhlenhake

(74) *Attorney, Agent, or Firm* — Fitzpatrick, Cella, Harper & Scinto

(57) ABSTRACT

A liquid ejection head has an element substrate constituted of a substrate body having a plurality of energy generating elements for liquid ejection and a nozzle plate having a plurality of ejection ports arranged corresponding to the respective energy generating elements so as to form a plurality of ejection port rows each extending in a first direction, the rows being arranged side by side so as to expand in a second direction intersecting the first direction. The nozzle plate has also a groove section, or a plurality of hollow sections arranged to form a hollow section row, as extending in the first direction, at least between one of the opposite edges as viewed in the second direction of the nozzle plate and the ejection port row arranged close to the same edge.

7 Claims, 9 Drawing Sheets

LIQUID EJECTION HEAD

BACKGROUND OF THE INVENTION

1. Field of the Invention

The present invention relates to a liquid ejection head for ejecting liquid such as ink.

2. Description of the Related Art

In recent years, there has been an increasing demand for image forming apparatus including inkjet printers that can operate at higher speed and produce better quality images than ever. To realize image forming apparatus that operate at higher speed and produce higher quality images, more ejection ports for ejecting liquid such as ink need to be formed at the nozzle plate of the liquid ejection head that the image forming apparatus includes. For this reason, a plurality of ejection ports are highly densely arranged at the nozzle plate of the liquid ejection head of any image forming apparatus that has been developed in recent years. As a result of densely arranging ejection ports, the liquid ejection head has been made to form better quality images than ever.

When ejection ports are densely arranged on the nozzle plate of a liquid ejection head, for example, at a rate of 600 dpi or 1,200 dpi, the gaps separating the ejection ports are inevitably reduced. Then, by turn the wall separating the ejection ports are inevitably made thin to consequently reduce the strength of the entire nozzle plate. As a result, the entire nozzle plate may probably be deformed by the stress given rise to by thermal energy to be used for ejecting liquid such as ink from the ejection ports. Such deformation will be particularly remarkable in a middle part of the nozzle plate as viewed in the running direction of the rows of ejection ports. Additionally, as larger liquid ejection heads come into use, the stress due to thermal energy tends to be concentrated in a middle part of the nozzle plate as viewed in the direction of the rows of ejection ports. As the nozzle plate is deformed, the ejection ports formed in the nozzle plate, or at least some of them, become deformed so that liquid may be ejected from the nozzle plate in directions other than the proper direction.

Japanese Patent Application Laid-Open No. 2000-158657 discloses a liquid ejection head including a nozzle plate (ejection port plate) having projections formed at positions located vis-à-vis the supply ports (ink supply ports) of the substrate body of the liquid ejection head for supplying liquid to the ejection ports (ink ejection ports) so as to project toward the substrate body. As the nozzle plate is provided with such projections, the rigidity of the entire nozzle plate is raised to make the nozzle plate less liable to be deformed.

Japanese Patent Application Laid-Open No. 2007-283501 discloses a liquid ejection head including a nozzle plate (ejection port plate) having pillar-shaped projections projecting from the projections (beam-like projections), which beam-like projections project into the common liquid chamber to supply the ejection ports with liquid, toward the ejection ports. As the nozzle plate is provided with such pillar-shaped projections projecting from the beam-like projections in addition to the beam-like projections arranged at the nozzle plate, the rigidity of the entire nozzle plate is further raised to make the nozzle plate much less liable to be deformed.

However, while the rigidity of the entire nozzle plate is raised by either of the inventions disclosed in Japanese Patent Application Laid-Open No. 2000-158657 and Japanese Patent Application Laid-Open No. 2007-283501, the problem that the stress due to thermal energy tends to be concentrated in a middle part of the nozzle plate as viewed in the direction of the rows of ejection ports is left unresolved. Therefore, if the liquid ejection head is operated for a long period of time and hence thermal energy is generated repeatedly, the nozzle plate of the liquid ejection head becomes liable to be deformed in a middle part of the nozzle plate as viewed in the direction of the rows of ejection ports by the stress due to thermal energy. As a middle part of the nozzle plate as viewed in the direction of the rows of ejection ports is deformed, the ejection ports at the middle part of the nozzle plate are also deformed so that liquid may no longer be ejected from the nozzle plate in the proper direction. Then, consequently the quality of the image formed by the liquid ejection head will inevitably be degraded.

On the other hand, if the rigidity of the entire nozzle plate is raised further by arranging larger projections on the nozzle plate in order to prevent a middle part of the nozzle plate as viewed in the direction of the rows of ejection ports from being deformed, the stress is concentrated not only to the nozzle plate itself but also to the surface of the nozzle plate and that of the substrate body that are bonded to each other. Then, the nozzle plate can come off from the substrate body to allow liquid to leak out from the gap between the substrate body and the nozzle plate. Then again, consequently the quality of the image formed by the liquid ejection head will inevitably be degraded.

SUMMARY OF THE INVENTION

According to the invention, the above identified problems are resolved by providing a liquid ejection head equipped with an element substrate, the element substrate including a substrate body having a plurality of energy generating elements for generating energy to be used to eject liquid and a nozzle plate provided on the substrate body, the nozzle plate having a plurality of ejection ports arranged at positions corresponding to the respective energy generating elements, the ejection ports being arranged to form a plurality of ejection port rows each extending in a first direction, the rows being arranged side by side so as to expand in a second direction, the first direction intersecting the second direction, wherein a groove section extending in the first direction is formed in the nozzle plate such that the groove section is located at least between one of the opposite edges as viewed in the second direction of the nozzle plate and the ejection port row arranged close to the same edge, and wherein the length in the second direction of the groove section at a middle part thereof as viewed in the first direction is greater than the length in the second direction of the groove section at end parts thereof as viewed in the first direction.

Further, according to the invention, the above identified problems are resolved by providing a liquid ejection head equipped with an element substrate, the element substrate including a substrate body having a plurality of energy generating elements for generating energy to be used to eject liquid and a nozzle plate provided on the substrate body, the nozzle plate having a plurality of ejection ports arranged at positions corresponding to the respective energy generating elements, the ejection ports being arranged to form a plurality of ejection port rows each extending in a first direction, the rows being arranged side by side so as to expand in a second direction, the first direction intersecting the second direction, wherein a plurality of hollow sections are formed in the nozzle plate to form a hollow section row extending in the first direction such that the hollow section row is located at least between one of the opposite edges as viewed in the second direction of the nozzle plate and the ejection port row arranged close to the same edge, and wherein the length in the second direction of the hollow sections at a middle part of the hollow section row as viewed in the first direction is greater than the length in the second direction of the hollow sections at end parts of the hollow section row as viewed in the first direction.

Further features of the present invention will become apparent from the following description of exemplary embodiments with reference to the attached drawings.

DESCRIPTION OF THE EMBODIMENTS

Now, the present invention will be described in greater detail by referring to the accompanying drawings that illustrate currently preferred embodiments of the invention.

(First Embodiment)

Figure 1:
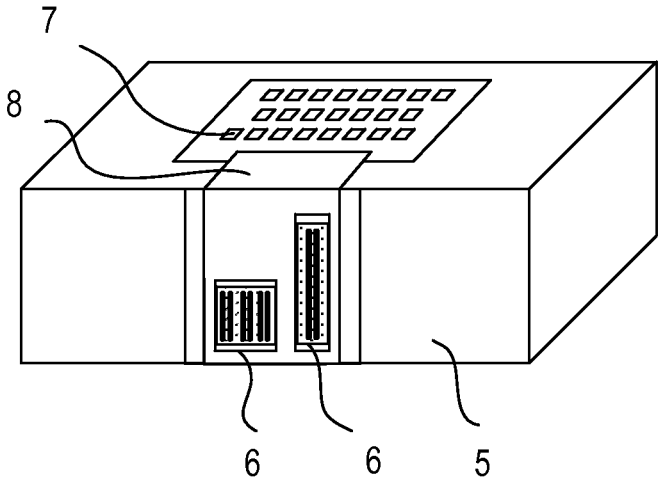
FIG. 1 is a schematic perspective view of a liquid ejection head according to the present invention.

FIG. 1 is a schematic perspective view of a general purpose liquid ejection head 5 that can be mounted in an image forming apparatus, a copying machine, a fax machine having a communication system, a word processor having an image forming section or any of a variety of industrial recording apparatus that is compositely combined with various processing devices. Such a liquid ejection head 5 can be used for recording operations using various recording mediums including paper, threads, fiber, leather, metal, plastic, glass, wood and ceramic. Note that, for the purpose of the present invention, the expression of "recording" refers not only to providing recording mediums with characters and/or graphics but also to providing recording mediums with images such as patterns that apparently do not have any meaning.

Figure 2A:
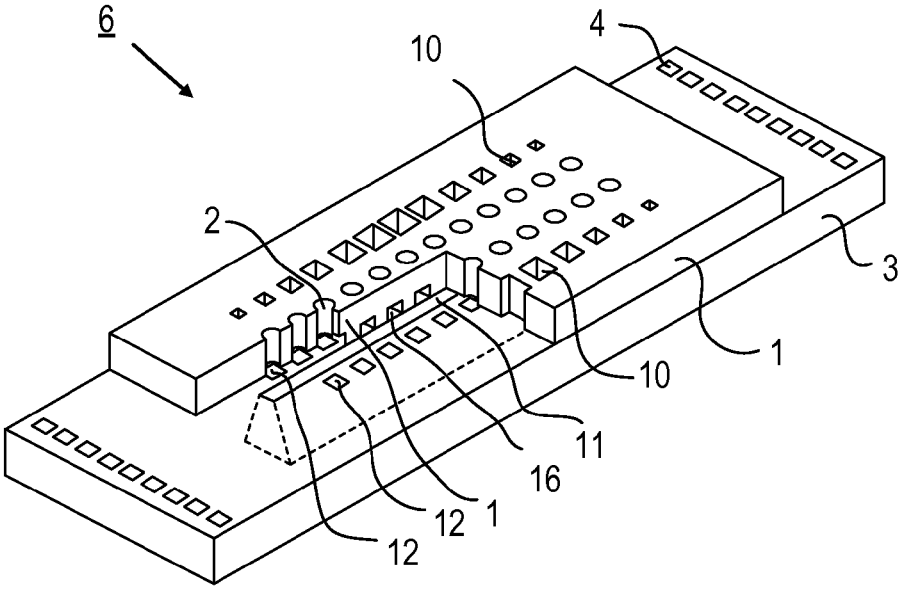
FIGS. 2A and 2B are a schematic perspective view and a schematic plan view, respectively, of the element substrate of a first embodiment of liquid ejection head according to the present invention.

The liquid ejection head 5 includes element substrates 6, contact pads 7 for receiving electric signals from outside such as the main body section (not illustrated) of an image forming apparatus or the like and a flexible wiring substrate 8 for conveying electric signals from the contact pads 7 to the element substrates 6. As illustrated in FIG. 2A, an element substrate 6 is formed by bonding a nozzle plate 1, in which a plurality of ejection ports 2 are formed to eject liquid such as ink, to one of the surfaces of a substrate body 3 having a plurality of energy generating elements 12 formed on that surface to emit thermal energy.

A plurality of rows (a pair of rows in this embodiment) of energy generating elements 12 are arranged on the above-described surface of the substrate body 3 and a supply port 11 for supplying liquid to the nozzle plate 1 is arranged such that the supply port 11 is sandwiched between the pair of rows of energy generating elements 12 as viewed from above. The energy generating elements 12 are typically formed by using electrothermal transducers (heaters) or piezoelectric elements. Electric power is supplied to the energy generating elements 12 by way of a plurality of terminals 4 arranged along some of the edges of the substrate body 3.

Figure 2B:
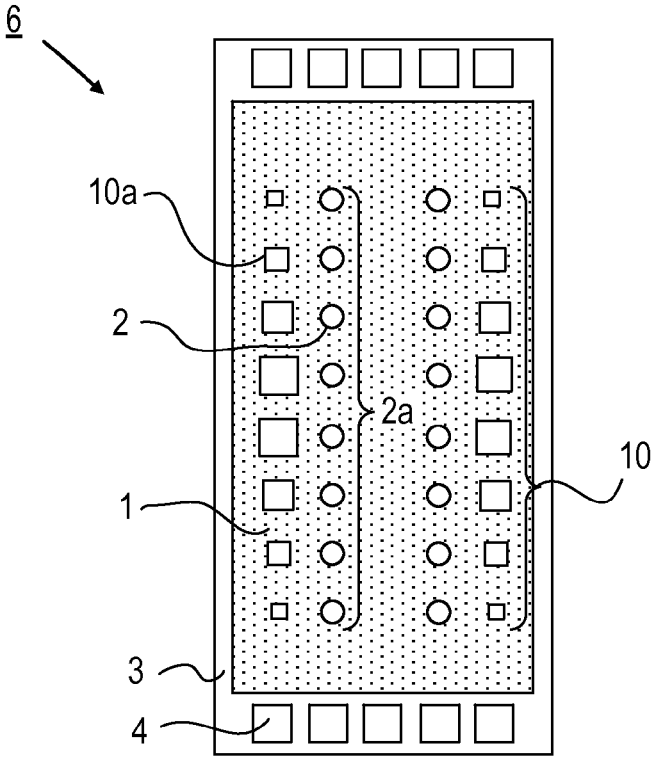

The ejection ports 2 are formed in the nozzle plate 1 at positions located right on the respective energy generating elements that are arranged on the above-described surface of the substrate body 3. The ejection ports 2 are arranged at a dot density of 600 dpi so as to form at least a row of ejection ports 2 that runs in a first direction. In this embodiment, a plurality of ejection port rows 2*a* (see FIG. 2B) are formed by ejection ports 2 and arranged side by side so as to expand in a second direction that intersects the first direction. The nozzle plate 1 is also provided with at least a hollow section row 10 that is formed by arranging a plurality of hollow sections 10*a* between the ejection port rows 2*a* and one of the opposite edges of the nozzle plate 1 running in parallel with the ejection port rows 2*a* so as to extend along the ejection port rows 2*a*. In this embodiment, a pair of hollow section rows 10 are formed so as to sandwich the pair of ejection port rows 2*a*. Recesses for producing so many liquid paths 16 that allow the liquid supplied from the supply ports 11 of the substrate body 3 to flow to the ejection ports 2 are formed on the surface of the nozzle plate 1 that faces the substrate body 3. Thus, as the nozzle plate 1 and the substrate body 3 are bonded to each other, the liquid paths 16 are produced between the nozzle plate 1 and the substrate body 3. While a single hollow section row 10 formed between one of the above-described opposite edges of the nozzle plate 1 and the ejection port row 2*a* arranged closest to the edge may suffice, two hollow section rows are preferably formed along the respective edges of the nozzle plate 1 as illustrated in FIG. 2B. Note that the hollow sections 10*a* do not communicate with the liquid paths 16.

As illustrated in FIG. 2B, each of the hollow section rows 10 is formed by a plurality of hollow sections 10*a* that are several holes arranged along the ejection port rows 2*a* of the nozzle plate 1. The hollow sections 10*a* of each of the hollow section rows 10 and the ejection ports 2 of the corresponding one of the ejection port rows 2*a* establish a one-to-one correspondence. Each of the hollow section rows 10 is formed such that the hollow sections 10*a* arranged at a middle part of the hollow section row 10 that corresponds to a middle part of the corresponding ejection port row 2*a* have a width (the length in the direction perpendicular to the running direction of the hollow section row 10) greater than the width of the hollow sections 10*a* arranged at the end parts of the hollow section row 10 that correspond to the end parts of the corresponding ejection port row 2*a*. More specifically, each of the hollow section rows 10 is so formed that the hollow sections 10*a* of the hollow section row 10 represent a width that gradually increases from the opposite ends of the row 10 toward the middle part of the hollow section row 10. Since square hollow sections 10*a* are formed in this embodiment, the gaps separating adjacent hollow sections 10*a* in the middle part are smaller than the gaps separating adjacent hollow sections 10*a* in the end parts of the nozzle plate 1. Note that the hollow sections 10*a* may not necessarily have a square shape but may alternatively have an oblong shape, a circular shape or some other shape.

To provide hollow section rows 10, a pattern of the hollow section rows 10 is arranged at the time of manufacturing the nozzle plate 1 in order to produce the hollow section rows 10. Negative photosensitive resin is then applied around the pattern to form the nozzle plate 1. Thus, since the pattern adheres to the negative photosensitive resin, the negative photosensitive resin can easily retain its original state that is observed when it is applied. Therefore, the ejection port opening side surface of the nozzle plate 1 can be formed highly accurately.

Figure 3A:
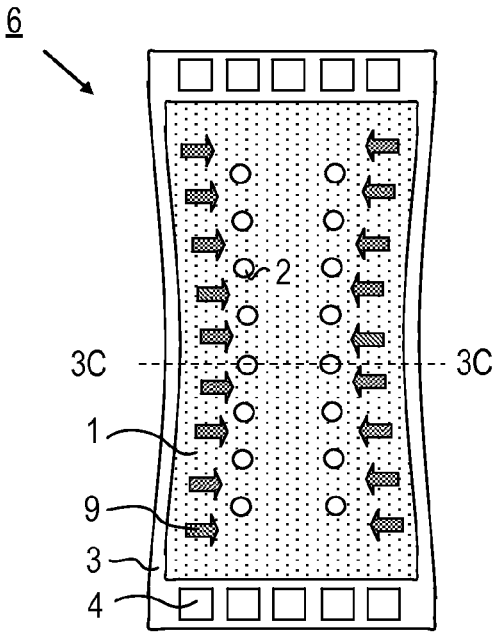
FIGS. 3A and 3C are a schematic plan view and a schematic cross sectional view, respectively, of the element substrate of a known liquid ejection head

In the element substrate 6 of any conventional liquid ejection head that is not provided with one or more than one hollow section row 10, the nozzle plate 1 is inevitably evenly subjected to stress 9 due to the thermal energy applied to it as illustrated in FIG. 3A. Since the rigidity of the nozzle plate 1 is lower at a middle part thereof, which corresponds to a middle part of the ejection port rows 2*a* where ejection ports 2 are formed as viewed in the running direction of the ejection port rows 2*a*, than at the end parts thereof, the nozzle plate 1 is deformed at the middle part thereof due to the stress 9 to which the nozzle plate 1 is evenly subjected. As the nozzle plate 1 is deformed at the middle part, the ejection ports 2 arranged in the middle part of the nozzle plate 1 are also deformed as illustrated in FIG. 3C so that the direction 17 in which the liquid droplets 13 are ejected from those ejection ports will be diverted from the proper direction. Then, those liquid droplets 13 hit the recording medium at positions that are displaced from their proper positions so that the image formed by those liquid droplets will represent a poor image quality.

Figure 3B:
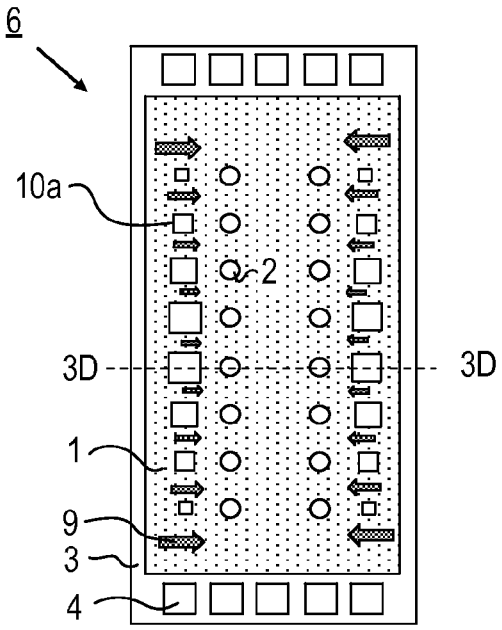
FIGS. 3B and 3D are a schematic plan view and a schematic cross sectional view, respectively, of the element substrate of the first embodiment of liquid ejection head according to the present invention.
Figure 3C:
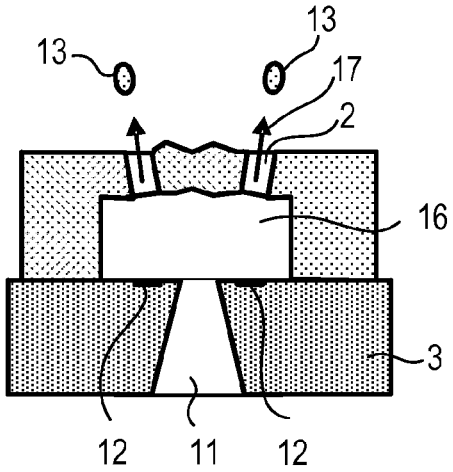
Figure 3D:
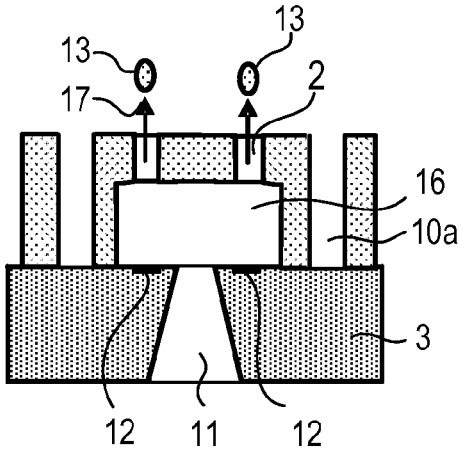

To the contrary, in the element substrate 6 of the liquid ejection head of this embodiment, the stress 9 to which the nozzle plate 1 is subjected can easily be dispersed as illustrated in FIG. 3B due to the hollow section rows 10 formed along the ejection port rows 2*a*. Particularly, the hollow section rows 10 have a width that is greater at the middle part thereof and smaller at the opposite end parts thereof so that the stress 9 to which the nozzle plate 1 is subjected at the middle part thereof is smaller than the stress 9 to which the nozzle plate 1 is subjected at the opposite end parts thereof. Thus, the nozzle plate 1 is less likely to be deformed at the middle part thereof due to the stress 9 so that the deformation, if any, of the ejection ports 2 at the middle part of the nozzle plate 1 is suppressed as illustrated in FIG. 3D. Then, the direction 17 in which the liquid droplets that are ejected from those ejection ports will be less likely to be diverted from the proper direction as illustrated in FIG. 3D. Thus, if those liquid droplets 13 hit the recording medium at positions that are displaced from their proper positions, the displacement will only be slight and hence the image formed by those liquid droplets will not represent any poor image quality. Additionally, since the nozzle plate 1 is subjected to stress 9 only to a small extent at the middle part thereof and hence the nozzle plate 1 is less likely to be deformed, the nozzle plate 1 would hardly come off from the substrate body 3 so that the problem of liquid leakage is suppressed to avoid possible degradation of the quality of the images to be formed by the liquid ejection head.

The element substrate 6 of the liquid ejection head of this embodiment can be manufactured by a method similar to the method of manufacturing the element substrates of conventional liquid ejection heads.

First, a substrate body 3 having a plurality of energy generating elements 12 formed on one of the surfaces thereof is prepared. In this embodiment, the plurality of energy generating elements 12 is arranged on the substrate body 3 in a pair of rows.

Next, fusible positive photosensitive resin is applied to the above-described surface of the substrate body 3 by means of a spin coater. Then, as the positive photosensitive resin is exposed to light, using an exposure mask that links each of the pairs of energy generating elements 12 that are arranged side by side and covers them, a pattern that is to operate as mold for forming the liquid paths 16 is produced.

After the pattern that is to operate as mold for forming the liquid paths 16 is produced, negative photosensitive resin that is later turned into the nozzle plate 1 is applied to the above-described surface of the substrate body 3 so as to cover the pattern that is to operate as mold for forming the liquid paths 16 by means of a spin coating technique or a roll coating technique. The use of a spin coating technique, which is a thin film coating technique, is advantageous because it can apply negative photosensitive resin uniformly and accurately. The material of the nozzle plate 1 is preferably a photosensitive material because ejection ports 2 can be accurately formed by photo-lithography when the nozzle plate 1 is made of a photosensitive material. The photosensitive material to be used to form the nozzle plate 1 is required to represent a high degree of resolution for the purpose of patterning ejection ports 2 having a delicate profile in addition to a high mechanical strength that allows it to operate as structure-forming material, a high degree of adhesiveness relative to the substrate body and a high degree of resistivity relative to ink. Materials having such properties include cathionic-polymerization-cured products of epoxy resin.

Subsequently, a pattern exposure process is executed on the negative photosensitive resin formed on the above-described surface of the substrate body 3, shielding the areas for forming the ejection ports 2 and the hollow sections 10*a* by means of a mask. Ultraviolet rays, deep UV rays, electron beams, X-rays or some other rays will appropriately be selected for use for the pattern exposure process depending on the photosensitity region of the cationic photopolymerization initiator to be employed. The negative photosensitive resin may well be subjected to a heating process in order to accelerate the reaction in the pattern exposure process. Since the cathionic-polymerization-cured product of epoxy resin to be used for the negative photosensitive resin exists as solid at room temperature, the spread, if any, of the cathionic polymerization initiator seeds that are generated by the pattern exposure process is limited so that an excellent patterning accuracy and an excellent profile can be realized.

As described above, a photo-lithography technique is applicable to both the step of forming a pattern that is to operate as mold for forming liquid paths 16 and the pattern exposure step to be executed on the negative photosensitive resin layer. Therefore if compared with conventional techniques of adhesively binding a nozzle plate 1 and a substrate body 3, ejection ports 2 and liquid paths 16 can be formed dimensionally highly accurately.

After the pattern exposure step, the negative photosensitive resin is developed by means of a solvent and turned into a nozzle plate 1 and a plurality of ejection ports 2 and a plurality of hollow sections 10*a* are formed in the nozzle plate 1. Thereafter, the ejection port side surface of the nozzle plate 1 is subjected to a hydrophilization process and a supply port 11 is formed in the substrate body 3 typically by means of anisotropic etching.

FIGS. 4A through 4F are schematic plan views of embodiments formed by modifying the liquid ejection head 5 of the first embodiment.

As illustrated in each of FIGS. 4A through 4D, a pair of groove sections 10 having a stress dispersing feature are formed in the nozzle plate 1 of the element substrate 6 of a liquid ejection head without forming hollow sections 10*a*. Each of the groove sections 10 extends along the ejection port rows and is made to represent a width that gradually increases from the opposite ends toward a middle part thereof.

Figure 4A:
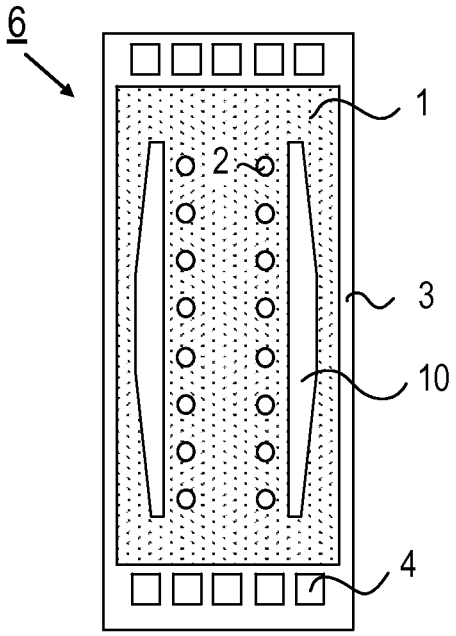
FIGS. 4A, 4B, 4C, 4D, 4E and 4F are schematic plan views of modifications of the first embodiment.
Figure 4B:
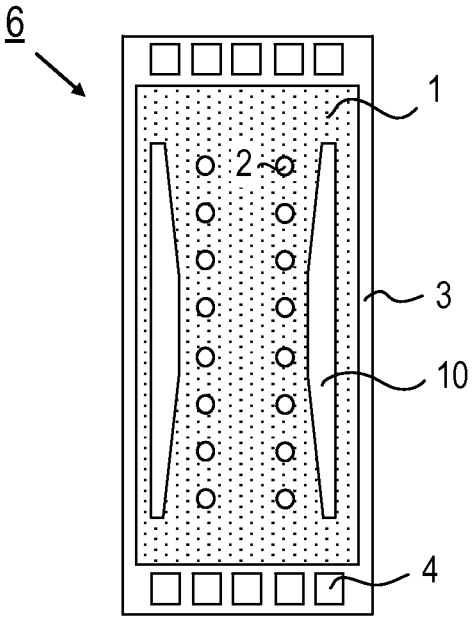
Figure 4C:
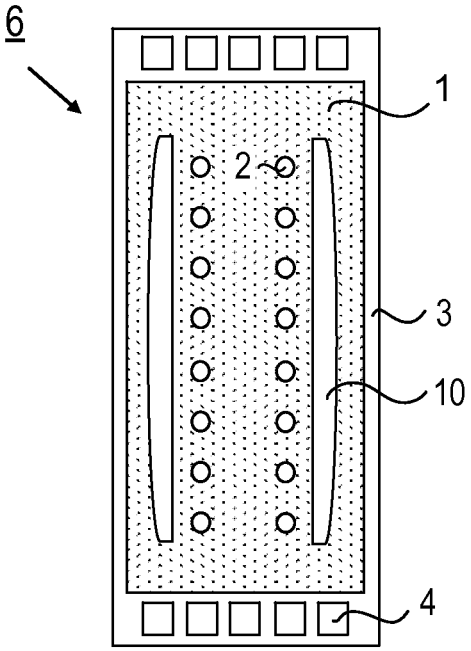
Figure 4D:
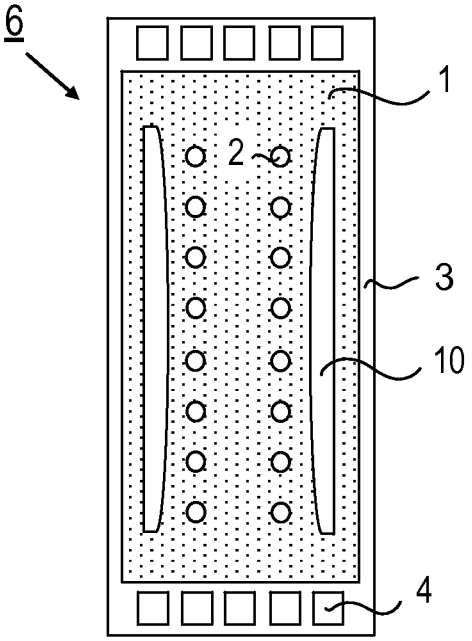
Figure 4E:
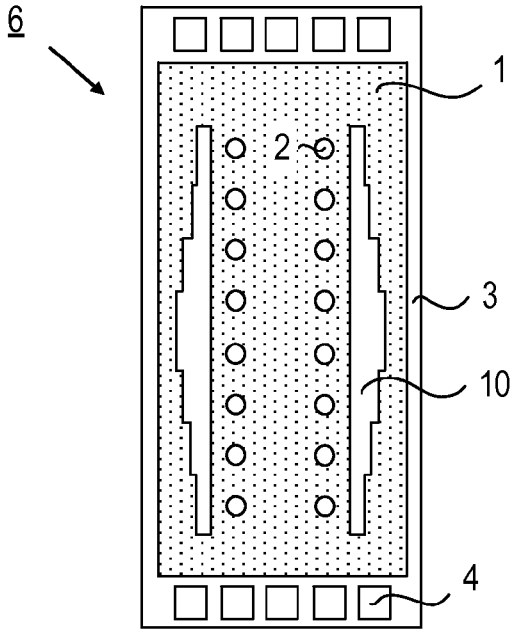
Figure 4F:
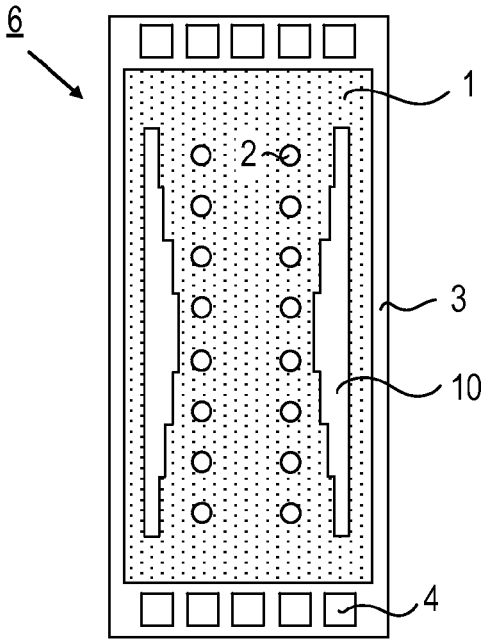

As illustrated in each of FIGS. 4E and 4F, a groove section 10 is formed in the nozzle plate 1 of the element substrate 6 of a liquid ejection head by means of a pair of grooves. Each of the groove sections 10 is made to represent a width that increases stepwise from the opposite ends toward a middle part thereof as viewed from above. The steps of the groove sections 10 are made to represent a height that varies depending on the position of the ejection port 2 that is arranged adjacent to each of the steps.

Figure 5:
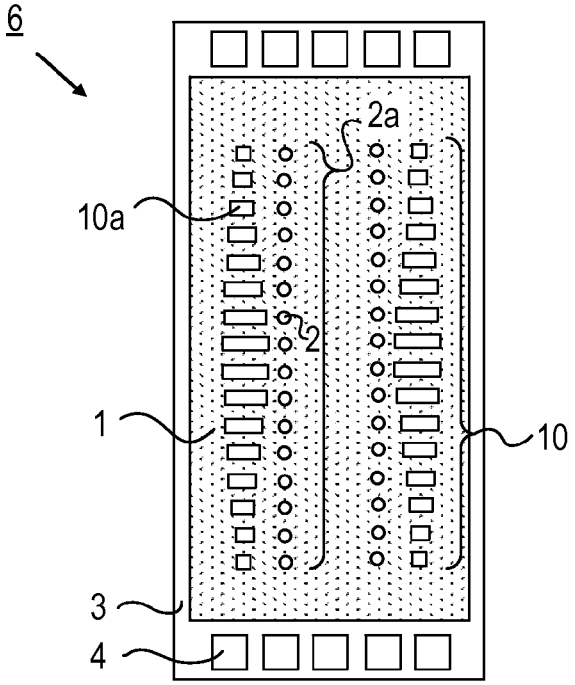
FIG. 5 is a schematic plan view of still another modification of the first embodiment.
Figure 6A:
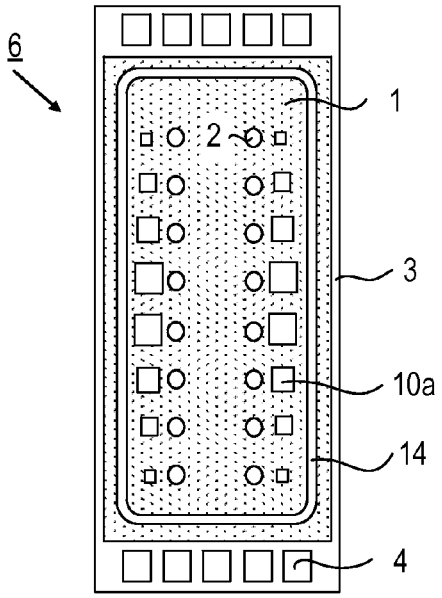
FIGS. 6A, 6B, 6C, 6D, 6E, 6F, 6G and 6H are schematic plan views of other modifications of the first embodiment.
Figure 6B:
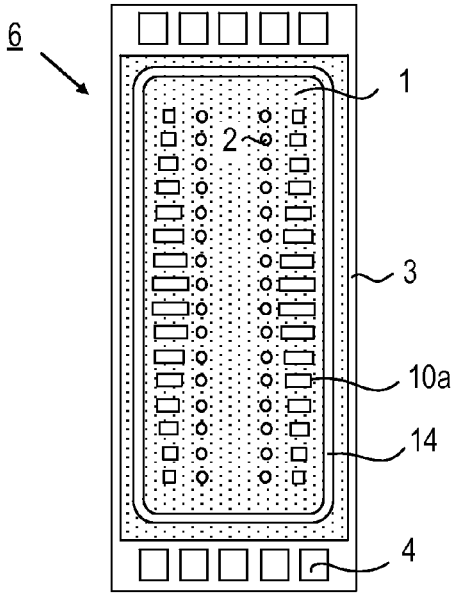
Figure 6C:
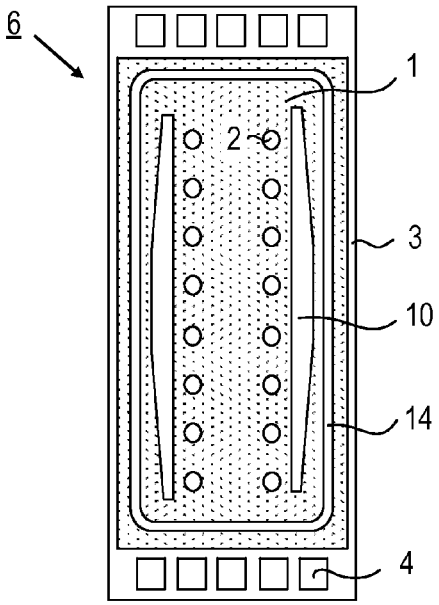
Figure 6D:
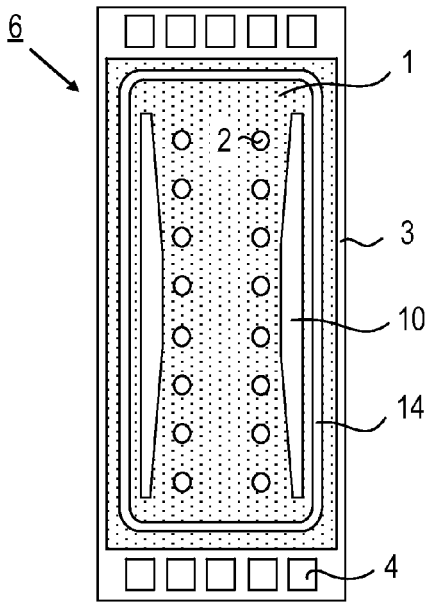
Figure 6E:
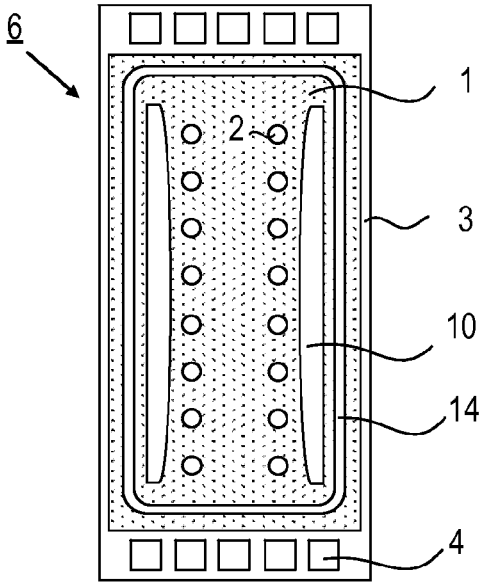
Figure 6F:
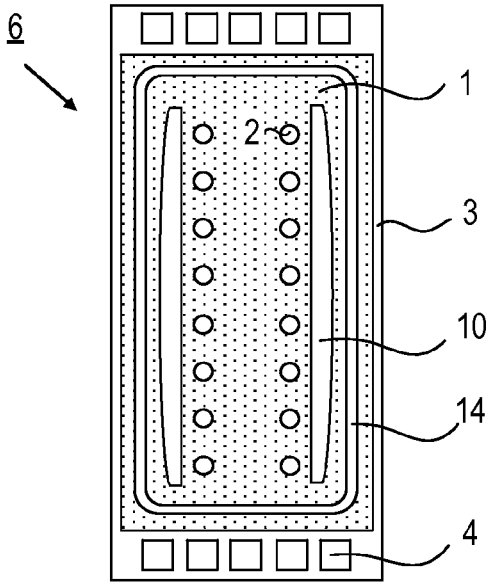
Figure 6G:
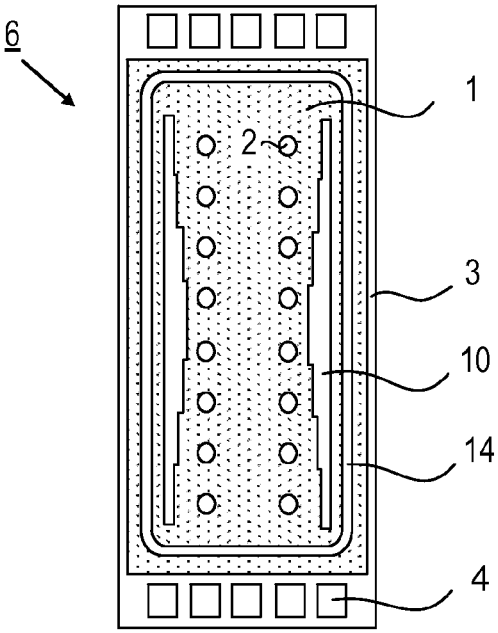
Figure 6H:
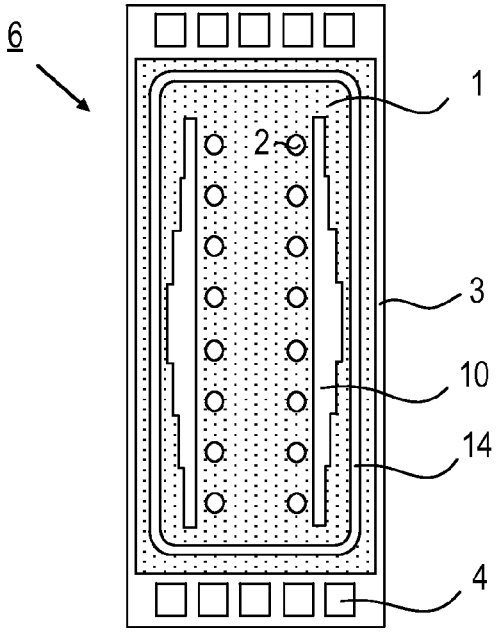

FIG. 5 is a schematic plan view of the element substrate 6 of still another modification of liquid ejection head of the first embodiment.

As illustrated in FIG. 5, ejection ports 2 are arranged at a dot density of 1,200 dpi so as to form a pair of ejection port rows 2*a* in the nozzle plate 1 of the element substrate 6 of the liquid ejection head. Hollow sections 10*a* are arranged to form a pair of hollow section rows 10 such that the hollow sections 10*a* of each of the hollow section rows 10 and the ejection ports 2 of the corresponding one of the ejection ports rows 2*a* establish a one-to-one correspondence. The hollow sections 10*a* of each of the hollow section rows 10 are made to represent a width that increases from the opposite ends toward a middle part thereof.

FIGS. 6A through 6H are schematic plan views of other modifications of the first embodiment, which correspond respectively to the first embodiment and the above-described modifications of the first embodiment. More specifically, each of the modifications of FIGS. 6A through 6H differs from the corresponding one of the preceding embodiments in that the modification additionally has a peripheral groove 14 formed on the nozzle plate 1 so as to surround the ejection ports 2 and the groove section or the hollow section rows 10. Such a peripheral groove 14 provides an effect that the ejection port side surface of the nozzle plate 1 can easily be formed highly accurately, the effect being similar to the effect obtained by arranging a grove section or a hollow section row 10. Then, the liquid droplets 13 ejected from the ejection ports (see FIG. 3D) will reliably fly out in the proper direction 17.

As pointed out above, the ejection port opening side surface of the nozzle plate 1 can easily be formed highly accurately by arranging a groove section or a hollow section row 10 so that the liquid droplets 13 ejected from the ejection ports 2 will reliably fly out in the proper direction.

Additionally, since groove sections or hollow section rows 10 are provided in a nozzle plate 1 such that the width of each of them is made to increase from the opposite end sides toward a middle part of the nozzle plate 1, the stress to which the nozzle plate 1 is subjected is dispersed and hence alleviated. Therefore, the nozzle plate 1 is less likely to be deformed at the middle part thereof so that the deformation, if any, of the ejection ports 2 at the middle part of the nozzle plate 1 is suppressed. Then, the direction 17 in which the liquid droplets 13 that are ejected from those ejection ports 2 will be less likely to be diverted from the proper direction and hence the image formed by those liquid droplets will not represent any poor image quality.

Furthermore, as the stress to which the nozzle plate 1 is subjected at a middle part thereof is reduced, the bonded surfaces of the nozzle plate 1 and the substrate body 3 are hardly subjected to stress so that the nozzle plate 1 would hardly come off from the substrate body 3 and hence the problem of liquid leakage from between the nozzle plate 1 and the substrate 3 hardly occurs to avoid possible degradation of the quality of the images to be formed by the liquid ejection head.

(Second Embodiment)

Figure 7:
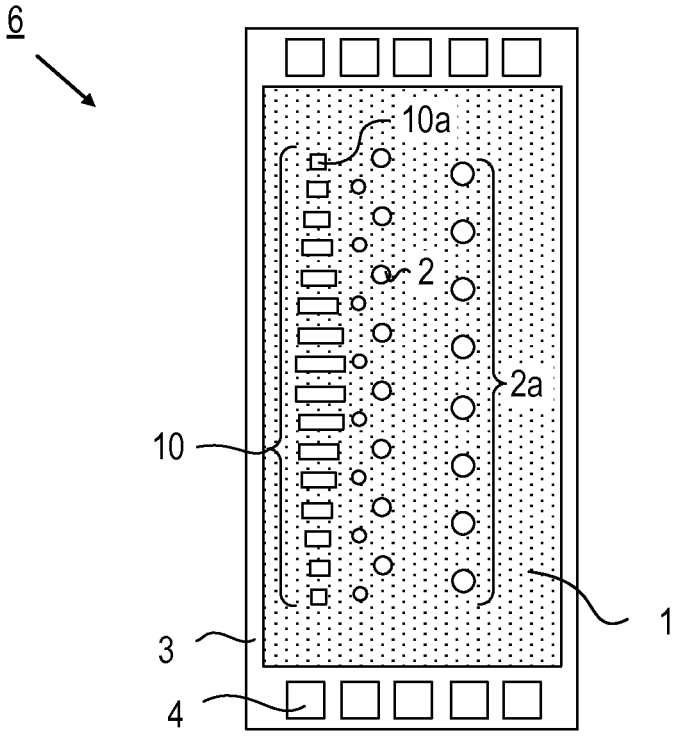
FIG. 7 is a schematic plan view of the element substrate of a second embodiment of liquid ejection head according to the present invention.

FIG. 7 is a schematic plan view of the element substrate 6 of the second embodiment of liquid ejection head according to the present invention.

An ejection port row 2*a* formed by arranging a plurality of ejection ports 2 at a dot density of 1,200 dpi and another ejection port row 2*a* formed by arranging a plurality of ejection ports 2 at a dot density of 600 dpi are disposed in parallel with each other in the nozzle plate 1 of the element substrate 6 of the liquid ejection head. A hollow section row 10 is arranged between the ejection port row 2*a* of 1,200 dpi and the edge of the nozzle plate 1 that is running along and located close to the ejection port row 2*a* of 1,200 dpi.

The hollow section row 10 is formed by a plurality of hollow sections 10*a* that are holes formed in the nozzle plate 1. The hollow sections 10*a* of the hollow section row 10 and the ejection ports 2 of the ejection ports row 2*a* of 1,200 dpi establish a one-to-one correspondence. As viewed in the running direction of the ejection port row 2*a*, the hollow sections 10*a* located at a middle part of the hollow section row 10 that corresponds to a middle part of the corresponding ejection port row are made to represent a width greater than the width of the hollow sections 10*a* located at opposite end parts of the hollow section row 10 that corresponds to opposite end parts of the ejection port row.

The remaining configuration of the second embodiment and the method of manufacturing the second embodiment are similar to those of the first embodiment and hence will not be described here repeatedly.

When a plurality of ejection port rows 2*a* are arranged with respective dot densities that are different from each other, the rigidity of the nozzle plate 1 is low at the side where the ejection port row 2*a* of the higher dot density is arranged. Therefore, the nozzle plate 1 is more apt to be deformed at the side where the ejection port row 2*a* of the higher dot density is arranged than at the opposite side. However, as the hollow section row 10 is formed along the ejection port row 2*a* of the higher dot density, the stress to which the nozzle plate 1 is subjected at the side where the ejection port row 2*a* of the higher dot density is formed is dispersed so that the deformation, if any, of the nozzle plate is suppressed. Particularly, the hollow section row 10 has a width that is greater at a middle part than at opposite end parts thereof so that the deformation, if any, of the nozzle plate 1 at the middle part is suppressed. Thus, the ejection ports 2 located at a middle part of the nozzle plate 1 is less likely to be deformed. Then, the direction 17 in which the liquid droplets 13 that are ejected from those ejection ports is less likely to be diverted from the proper direction as illustrated in FIG. 3D. Then, if those liquid droplets 13 hit the recording medium at positions that are displaced from their proper positions, the displacement will only be slight and hence the image formed by those liquid droplets will not represent any poor image quality. Additionally, since the nozzle 1 is subjected to stress 9 only to a small extent at a middle part thereof and hence the nozzle plate 1 is less likely to be deformed, the nozzle plate 1 would hardly come off from the substrate body 3 so that the problem of liquid leakage is suppressed to avoid possible degradation of the quality of the images to be formed by the liquid ejection head.

Figure 8:
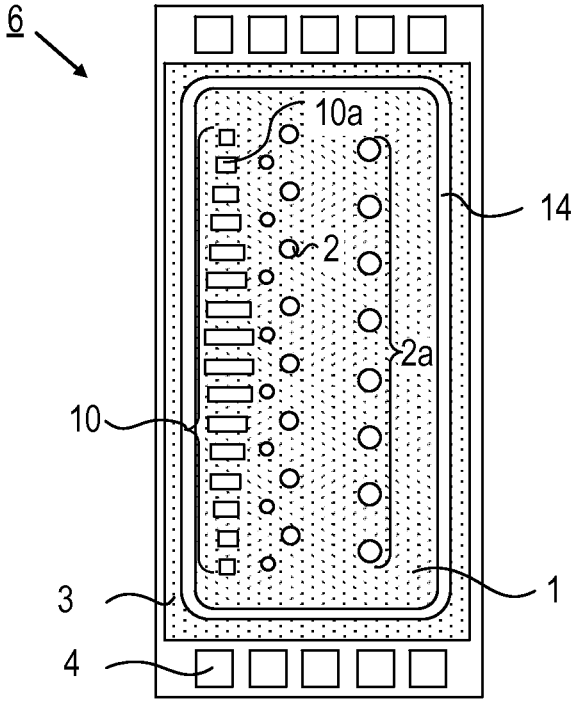
FIG. 8 is a schematic plan view of a modification of the second embodiment.

FIG. 8 is a schematic plan view of a modification of the second embodiment.

In the element substrate 6 of the liquid ejection head of this modification, a peripheral groove 14 is formed in the nozzle plate 1 thereof so as to surround the ejection ports 2 and the hollow section row 10. Such a peripheral groove 14 provides an effect that the ejection port side surface of the nozzle plate 1 can easily be formed highly accurately. Then, the liquid droplets 13 ejected from the ejection ports 2 will reliably fly out in the proper direction.

A hollow section row 10 is provided only between the ejection port row 2*a* of the higher dot density and the edge of the nozzle plate 1 located close to the ejection port row 10 in both the second embodiment and the modification of the second embodiment in the above description. However, a hollow section row 10 may also be provided between the ejection port row 2*a* of the lower dot density and the edge of the nozzle plate 1 located close to the ejection port row 2*a* of the lower dot density. In such an instance, again, the hollow section row 10 is formed so as to represent a width that is large at the middle part thereof and becomes smaller toward the opposite ends thereof and hence the stress to which the middle part of the nozzle plate 1 is subjected at the side where the ejection port row 2*a* of the lower dot density is formed is dispersed so that the nozzle plate 1 is less likely to be deformed and hence the image formed by the second embodiment or the modification thereof will not represent any poor image quality.

(Third Embodiment)

Figure 9A:
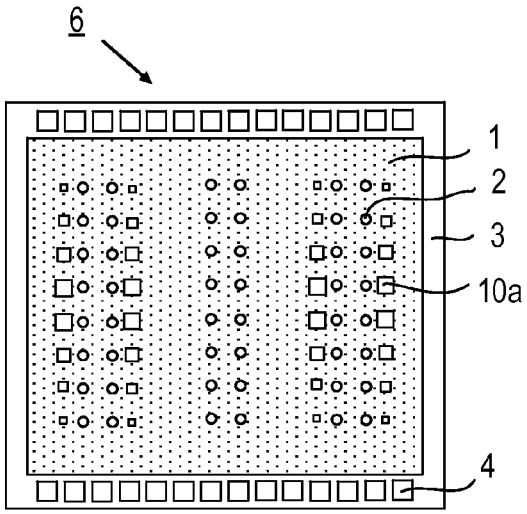
FIG. 9A is a schematic plan view of the element substrate of a third embodiment of liquid ejection head according to the present invention and FIG. 9B is a schematic plan view of a modification of the third embodiment.

FIG. 9A is a schematic plan view of the element substrate 6 of the third embodiment of liquid ejection head according to the present invention.

As illustrated in FIG. 9A, a plurality of ejection port rows 2*a*, each of which is formed by a plurality of ejection ports 2, are arranged on one of the surfaces of the nozzle plate 1 of the element substrate 6 of a liquid ejection head. More specifically, a plurality of pairs of ejection port rows 2*a* is arranged in this embodiment. As a plurality of pairs of ejection port rows 2*a* is arranged, liquids of mutually different types can be ejected from the respective pairs of ejection port rows 2*a*. Additionally, two pairs of hollow section rows 10 are provided such that the two pairs of ejection port rows 2*a* that are located closest to the opposite edges of the nozzle plate 1 running in parallel with the ejection port rows 2 are sandwiched between the respective pairs of hollow section rows 10. No hollow section row 10 is provided along any ejection port row 2*a* other than the two pairs of ejection port rows 2*a* that are located closest to the opposite edges of the nozzle plate 1 running in parallel with the ejection port rows 2*a*.

The remaining configuration of the second embodiment and the method of manufacturing the second embodiment are similar to those of the first embodiment and hence will not be described here repeatedly.

Because of stress due to thermal energy, a nozzle plate 1 on which a plurality of pairs of ejection port rows 2*a* are arranged is apt to be deformed from a middle part of each of the edges running in parallel with the ejection port rows 2*a* toward the center of the nozzle plate 1. Then, as a result, the ejection port rows 2*a* located close to the edges of the nozzle plate 1 running in parallel with the ejection port rows 2*a* are apt to be deformed so that liquid droplets 13 may be ejected from the nozzle plate in directions other than the proper direction.

In this embodiment, the stress to which the nozzle plate is subjected is dispersed because hollow section rows 10 are arranged so as to sandwich the pair of ejection port rows 2*a* that are located closest to the opposite edges of the nozzle plate 1 running in parallel with the ejection port rows 2*a*. Since each of the hollow section rows 10 is so configured as to represent a width that is large at a middle part thereof and small at the opposite end parts thereof, particularly the stress 9 to which the middle part of the hollow section rows 10 is subjected is dispersed and, accordingly the stress to which the middle part of the nozzle plate 1 is subjected is reduced. Thus, the nozzle plate 1 is less likely to be deformed at the middle part thereof due to stress 9 so that the deformation, if any, of the ejection ports 2 at a middle part of the nozzle plate 1 is suppressed as illustrated in FIG. 3D. Then, the direction 17 in which the liquid droplets 13 that are ejected from those ejection ports will be less likely to be diverted from the proper direction as illustrated in FIG. 3D. Then, if those liquid droplets 13 hit the recording medium at positions that are displaced from their proper positions, the displacement will only be slight and hence the image formed by those liquid droplets will not represent any poor image quality. Additionally, since the nozzle plate 1 is subjected to stress 9 only to a small extent at a middle part thereof and hence the nozzle plate 1 is less likely to be deformed, the nozzle plate 1 would hardly come off from the substrate body 3 so that the problem of liquid leakage is suppressed to avoid degradation of the quality of the images to be formed by the liquid ejection head.

Figure 9B:
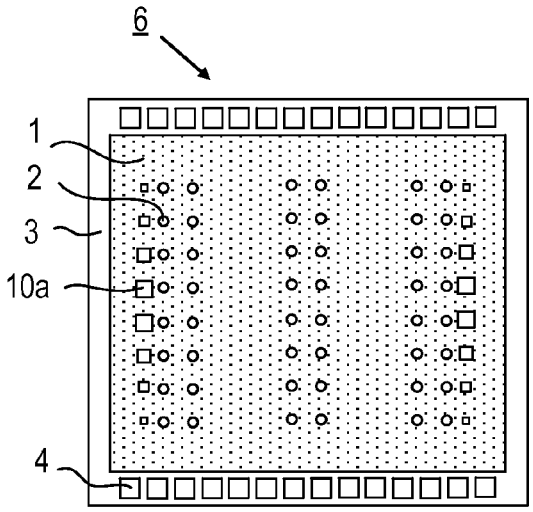

FIG. 9B is a schematic plan view of a modification of the third embodiment.

This modification differs from the third embodiment in that a hollow section row 10, which is so configured as to represent a width that is large at the middle part thereof and small at the opposite end parts thereof, is arranged only along each of the edges running in parallel with the ejection port rows 2*a* and between the edge and the ejection port row 2*a* located close to the edge.

In situations where a liquid ejection head is operated only for a short period of time and hence stress is less likely to be given rise to by thermal energy, the stress to which the nozzle plate 1 is subjected can be satisfactorily dispersed when a hollow section row 10 is arranged only between each of the edges running in parallel with the ejection port rows and the ejection port row 2*a* located close to the edge. Thus, this modification provides an effect similar to that of the third embodiment.

Figure 10A:
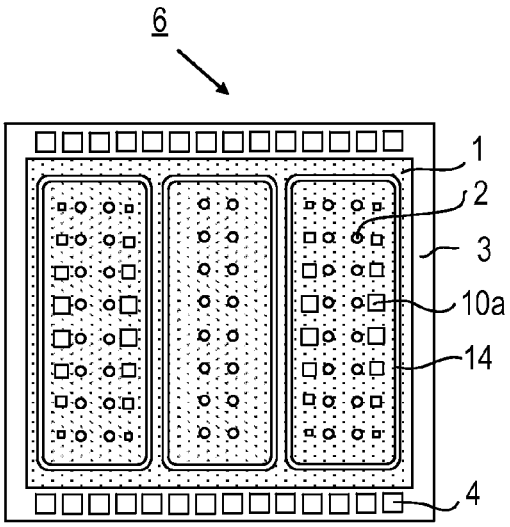
FIGS. 10A and 10B are schematic plan views of modifications of the third embodiment.
Figure 10B:
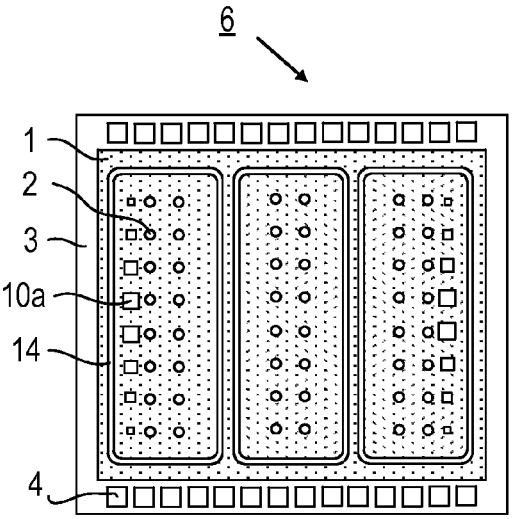

FIGS. 10A and 10B illustrate still other modifications which correspond to the third embodiment and the above-described modification respectively. More specifically, the modifications of FIGS. 10A and 10B differ from the third embodiment and the preceding modification in that each of the modifications has a plurality of peripheral grooves 14 formed on the nozzle plate 1 and each of the peripheral grooves 14 surrounds at least one of the ejection port rows 2*a*. Additionally, at least one of the peripheral grooves 14 surrounds one of the hollow section rows 10 in addition to one of the ejection port rows 2*a*. As peripheral grooves 14 are formed on the nozzle plate so as to surround ejection port rows 2*a* and hollow section rows 10, the ejection port side surface of the nozzle plate 1 can easily be formed highly accurately. Then, the liquid droplets 13 ejected from the ejection ports 2 will reliably fly out in the proper direction. Additionally, as the ejection port rows 2*a* are surrounded by peripheral grooves 14, when the liquid ejected from the ejection port rows 2*a* overflows onto the above-described surface of the nozzle plate 1, the overflowing liquid will easily be accumulated in the regions surrounded by the peripheral groves 14. Then, the liquid overflowing from some of the ejection ports would not get to the vicinities of the neighboring ejection port rows 2*a* that are ejecting liquid of one or more than one types different from the type of the former liquid. Thus, liquids of different types would not be mixed with each other and hence degradation, if any, of image quality due to mixed liquid is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-118725, filed Jun. 5, 2013, which is hereby incorporated by reference herein in its entirety.

What is claimed is:

1. A liquid ejection head equipped with an element substrate, the element substrate comprising:

a substrate body having a plurality of energy generating elements for generating energy to be used to eject liquid; and a nozzle plate provided on the substrate body, the nozzle plate having a plurality of ejection ports arranged at positions corresponding to the respective energy generating elements, the ejection ports being arranged to form a plurality of ejection port rows each extending in a first direction, the rows being arranged side by side and spaced in a second direction, the first direction intersecting the second direction, wherein a plurality of hollow sections, which are independent of each other, are formed in the nozzle plate to form a hollow section row extending in the first direction such that the hollow section row is formed at least between one of the opposite edges of the nozzle plate as viewed in the second direction and the ejection port row arranged close to the same edge, and wherein, of the plurality of hollow sections included in the hollow section row whose length corresponds to the length of the ejection port rows, the dimension in the second direction of each of the hollow sections at a middle part of the hollow section row with respect to the first direction is greater than the dimension in the second direction of each of the hollow sections at end parts of the hollow section row with respect to the first direction.

2. The liquid ejection head according to claim 1, wherein a liquid path is formed between the nozzle plate and the substrate body to supply liquid to the energy generating elements, the liquid path not being in communication with the hollow sections.

3. The liquid ejection head according to claim 1, wherein hollow section rows are formed between each of the opposite edges of the nozzle plate and the corresponding ejection port row arranged close to the edge.

4. The liquid ejection head according to claim 1, wherein a peripheral groove is formed on the nozzle plate so as to surround the ejection port rows and the hollow section row.

5. The liquid ejection head according to claim 1, wherein the length in the second direction of the hollow sections is gradually reduced from the middle part of the hollow section row toward each of the end parts of the hollow section row with respect to the first direction.

6. The liquid ejection head according to claim 1, wherein the length in the first direction of the hollow section row corresponds to the length in the first direction of the ejection port row.

7. The liquid ejection head according to claim 1, wherein an opening of each of the plurality of hollow sections has a rectangular shape.

* * * * *